United States Patent [19]

Simmel et al.

[11] Patent Number: 5,058,636

[45] Date of Patent: Oct. 22, 1991

[54] LIQUID FLOW CONTROLLING SYSTEM

[75] Inventors: Thomas L. Simmel; Craig A. Baker, both of Milford, Conn.

[73] Assignee: Link Research & Development, Inc., Milford, Conn.

[21] Appl. No.: 520,518

[22] Filed: May 8, 1990

Related U.S. Application Data

[63] Continuation-in-part of Ser. No. 211,811, Jun. 27, 1988, Pat. No. 4,924,921.

[51] Int. Cl.[5] ..... B67C 3/00; B65B 39/04

[52] U.S. Cl. ..... 141/346; 141/290; 141/293; 141/295; 141/308; 141/309; 141/320; 141/354; 141/357; 141/387

[58] Field of Search ..... 141/285, 286, 290, 291-296, 141/302, 305, 308, 309, 319-321, 346-355, 357, 387, 383, 386

[56] References Cited

U.S. PATENT DOCUMENTS

| | | | |
|---|---|---|---|
| 176,600 | 4/1876 | Covel | 141/309 |
| 245,401 | 8/1881 | Raynor et al. | 141/293 |
| 668,303 | 2/1901 | Beyer | 141/353 |
| 1,580,737 | 4/1926 | Kettelson | 141/309 |
| 2,272,208 | 2/1942 | Jergenson | 141/294 |
| 2,401,674 | 6/1946 | Vizay | 141/294 |
| 2,628,759 | 2/1953 | Bodendoerfen | 141/293 |
| 3,045,721 | 7/1962 | Shepherd et al. | 141/346 |
| 3,139,123 | 6/1964 | Lisciani | 141/309 |
| 3,171,448 | 3/1965 | Fromm | 141/346 X |
| 3,190,322 | 6/1965 | Brown | 141/387 |
| 3,278,094 | 10/1966 | Perry | 141/291 X |
| 4,598,743 | 7/1986 | Milling | 141/296 |
| 4,907,630 | 3/1990 | Kulikowski et al. | 141/384 |
| 4,924,921 | 5/1990 | Simmel et al. | 141/286 |

FOREIGN PATENT DOCUMENTS

| | | | |
|---|---|---|---|
| 104680 | 8/1937 | Australia | 141/351 |
| 701374 | 1/1965 | Canada | 141/290 |
| 18492 | 8/1956 | Fed. Rep. of Germany | 141/285 |
| 845756 | 9/1939 | France | 141/285 |

*Primary Examiner*—Ernest G. Cusick
*Attorney, Agent, or Firm*—Melvin I. Stoltz

[57] ABSTRACT

By employing two independent, separate and distinct flow paths which are controllably sequentially opened during use in a single actuation operation, an error-free, spill-free flame and explosion proof liquid delivery/filling system is achieved. In the preferred embodiment, both flow paths are normally maintained in a closed, sealed configuration, requiring an actuation force to controllably, sequentially open the flow paths. In addition, by providing a cooperating, mating liquid transfer assembly, the container on which the liquid delivery/-filling system is mounted can be refilled with safety and ease, completely eliminating spillage of the liquid. In this way, a fully integrated, cooperating, liquid flow controlling system is realized.

11 Claims, 7 Drawing Sheets

LIQUID FLOW CONTROLLING SYSTEM

RELATED APPLICATION

This application is a continuation-in-part patent application of U.S. Ser. No. 211,811, filed June 27, 1988, now U.S. Pat. 4,924,921.

BACKGROUND ART

For many years, safe, trouble-free delivery or transferal of various liquids, particularly flammable liquids and toxic or hazardous liquids, has long been a problem which has plagued the industry. In particular, in situations where small quantities of flammable or toxic liquids are to be transferred from a storage container to an active, usable reservoir, such as the gasoline tank of motor vehicles or a holding tank for dilution, the difficulties typically encountered with transferring flammable liquids become most acute.

In an attempt to reduce or eliminate these difficulties, various systems and adaptors have become available. However, these prior art systems have failed to eliminate the inherent danger or to overcome the problems and dangers.

The most severe problems being encountered are the spontaneous eruption of an uncontrolled fire and unwanted explosions often followed by fire. These catastrophic incidents have occurred most frequently in the rapid delivery of gasoline from a storage container to the tank or reservoir of a vehicle during an on-going race.

In such situations, particularly with racing cars, motorcycles and all terrain vehicles, speed of delivery is important. In addition, particularly with motorcycles, all terrain vehicles and small cars, the fuel tank size does not allow pressurized pump delivery systems. Consequently, gravity delivery is employed, with the desirability of high speed often leading to carelessness.

In these gravity-based delivery situations, it has been found that gasoline vapors build up in the storage container prior to use, particularly when the ambient temperatures are high or the storage tanks are left out in direct sunlight. During the rush to rapidly fill the gasoline tank for continued racing, the storage tank is inadvertently not vented prior to use. Consequently, the highly flammable, pressurized gasoline vapors are allowed to come into rapid contact with the hot motor vehicle, often causing an unwanted fire or explosion.

In addition, prior art delivery systems have failed to eliminate unwanted spillage. Consequently, gasoline is often spilled on the hot motor vehicle during the delivery process. This spillage is also very dangerous and has also resulted in unwanted fires.

Similarly, in transferring toxic or hazardous liquids, spillage continues to be a primary problem, as well as unsafe disposal of the container bearing the concentrated toxic liquid after it is used.

Although these problems and difficulties have existed in the industry for many years, no prior art system exists which completely eliminates the inherent dangers found in these liquid delivery situations.

Therefore, it is a principal object of the present invention to provide a liquid flow controlling system which is capable of controllably delivering liquid to a tank or container in a safe, error free manner.

Another object of the present invention is to provide a liquid flow controlling system having the characteristic features described above which provides positive, automatic flow control means to assure that the liquid is being delivered only when safe to do so.

Another object of the present invention is to provide a liquid flow controlling system having the characteristic features described above which substantially reduces any chance of fires or explosions during the gravity delivery of liquid from one reservoir to another.

Another object of the present invention is to provide a liquid flow controlling system having the characteristic features described above which virtually eliminates dangerous spillage of the liquid being delivered.

Other and more specific objects will in part be obvious and will in part appear hereinafter.

SUMMARY OF THE INVENTION

The present invention overcomes prior art difficulties by providing two separate and distinct flow channels both of which are controllably opened in a specific, pre-set sequence, upon actuation. In this way, the liquid delivery/filling system of the present invention assures that upon actuation the liquid is safely delivered from the first storage reservoir to the second active reservoir, while being completely closed prior to actuation.

By providing two completely independent and separate flow channels, the liquid is controllably delivered along one flow path or channel, while the second flow path or channel assures controlled removal of displaced air from the chamber being filled. In addition, the air is delivered to a zone above the liquid level. This prevents unwanted air flow or bubbling through the liquid itself, thereby eliminating one primary source of spillage.

Furthermore, by mounting the system in a normally closed position and providing the sequential controlled actuation of the two independent flow channels when desired, the liquid delivery/filling system of the present invention eliminates the second source of spillage, as well as safely controlling any vapor build up in the storage container. The present invention substantially reduces any possibility that vapor pressure build up will be accidentally ignited or that liquid will be spilled in unwanted or undesirable areas.

In the preferred construction, the two, independent flow channels are constructed concentrically, in order to provide a compact and easily usable construction. In addition, the controlled, sequential actuation is achieved in a positive, automatic error free manner. As a result, regardless of user knowledge, trouble-free use is attained.

Furthermore, the liquid delivery/filling system of the present invention incorporates flow shut-off means which automatically discontinues the delivery of the liquid to the active reservoir when the reservoir has been filled. By incorporating automatic flow shut-off means, in combination with the other features detailed above, the fluid delivery/filling system of the present invention provides for the safe transferal or delivery of flammable or toxic liquids, without the dangers and problems that have plagued the industry.

In addition, in order to provide for the safe transferal of flammable or toxic liquids from a storage container to an active, usable container or reservoir, the present invention also comprises a cooperating, mating, system-engaging refilling assembly for being lockingly mounted to the liquid delivery/filling system, securing the system in its open position and enabling the storage container to be refilled both safely and speedily. In this way, the storage container can be repeatedly reused after the safe refilling thereof, thereby enabling the liquid delivery/filling system mounted thereto to be continuously used to prevent unwanted spillage.

The integrated, interlocking mating/refilling assembly of this invention is of particular importance in assuring the safe delivery and use of toxic and hazardous chemicals and liquids, such as chemical fertilizers, pesticides and insecticides which are environmentally safe when diluted, but highly toxic or hazardous when spilled in their concentrated form. In many applications throughout the country, chemical fertilizers, pesticides and insecticides are applied to crops, plants, trees, etc. in order to either enhance their growth or reduce or eliminate the damage caused by insects or other crop feeding animals.

Typically, the concentrated toxic or hazardous chemical liquids are transferred from a liquid storage container to an active, usable reservoir in which the toxic chemical liquid is diluted for safe application to the crops, plants, trees or other farmed product. In order to assure safe, trouble-free transferal of the hazardous or toxic concentrated chemical liquids from the storage container to the active, usable reservoir, the liquid delivery/filling system of the present invention is employed.

In this particular application, it has been found that toxic or hazardous liquids have been able to cause unwanted contamination due to the discarding of the storage container used for holding the concentrated hazardous chemical liquid. Consequently, in order to eliminate this unwanted contamination, an alternate embodiment of the present invention comprises an integrated, interlocking mating/refilling assembly which cooperatingly engages the liquid delivery/filling system for enabling the storage container to be refilled. In this way, the storage container is repeatedly reused, thereby preventing its disposal and the unwanted contamination of the surrounding environment by the residual chemicals contained therein.

In order to enable the storage container to be repeatedly reused, the liquid delivery/filling system is preferably fixedly mounted to the storage container and the cooperating, integrated, interlocking mating/refilling assembly lockingly mounts to the liquid delivery/filling system, automatically causing the delivery/filling system to be fixed in its open position, enabling the safe, efficient, spill-free refilling of the storage container for subsequent reuse. In this way, the storage containers are not discarded and, thereby, do not cause contamination. Furthermore, each concentrated chemical holding storage container incorporates a liquid delivery/filling system of this invention, thereby effectively eliminating unwanted spillage of the toxic liquid contained therein.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

Figure 11:
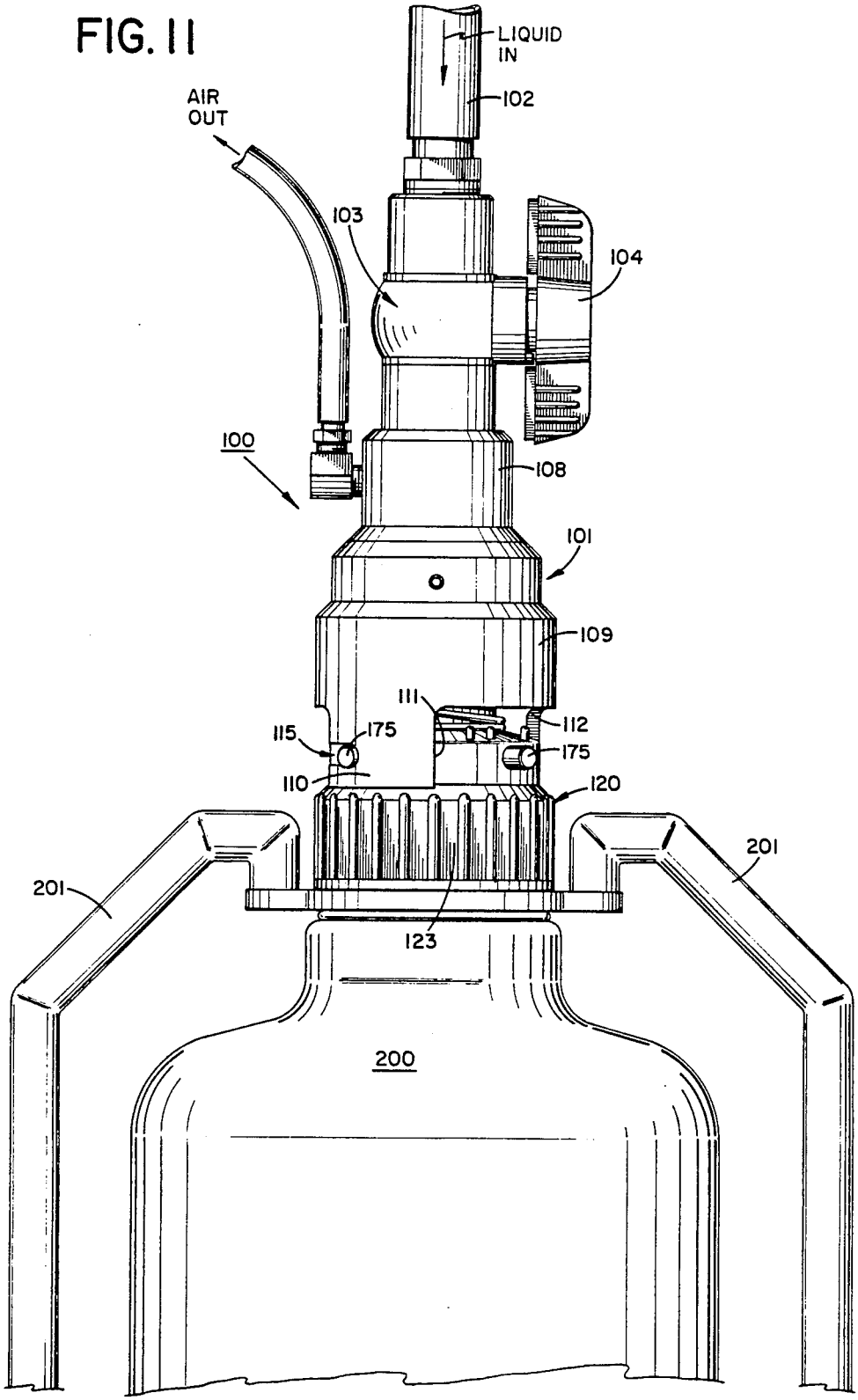
Figure 12:
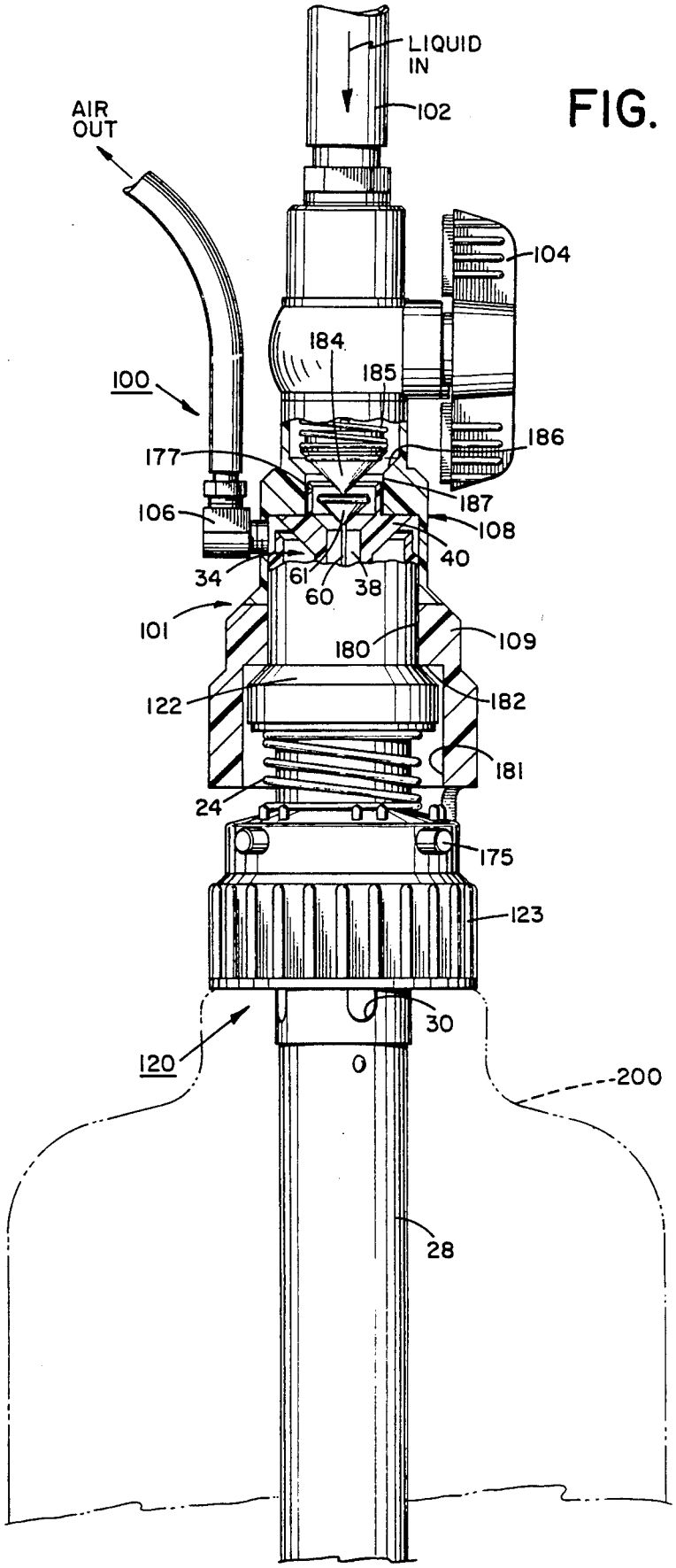

FIG. 11 is a side elevation view, partially broken away, depicting the liquid transfer assembly of the present invention in locked engagement with the liquid delivery/filling system of this invention, with the liquid delivery/filling system securely mounted to a reusable container; and FIG. 12 is a side elevation view, partially broken away, similar to the view of FIG. 11, with the liquid transfer assembly of the present invention depicted securely affixed to the liquid delivery/filling system of this invention.

DETAILED DESCRIPTION

Figure 1:
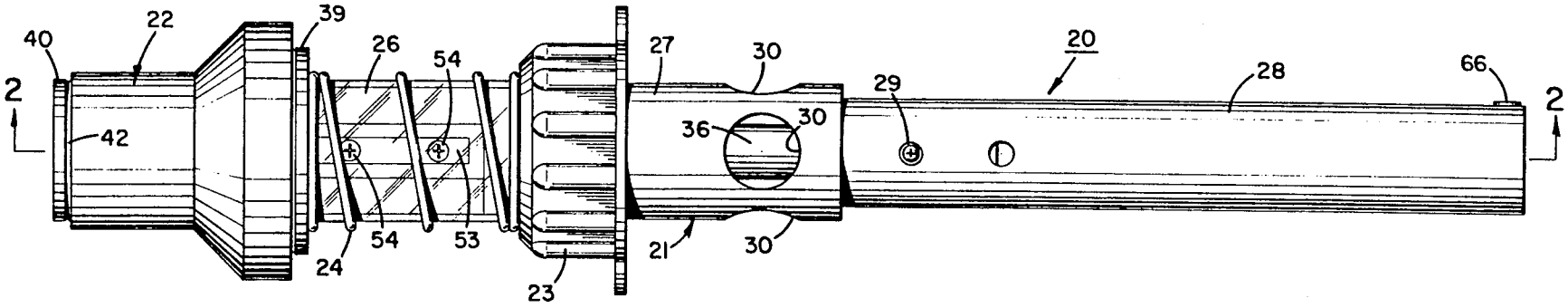
FIG. 1 is a side elevational view of the fluid delivery/filling system of the present invention shown fully assembled, and in its normally closed position.

As shown in FIG. 1, the liquid delivery/filling system 20 of the present invention comprises an elongated, outer tube 21 to which is mounted a slidable collar 22 and a sealing cap 23. In addition, coil spring 24 is mounted about tube 21 between collar 22 and cap 23 to maintain slidable collar 22 in its fully extended, forwardmost flow sealing position.

Figure 2:
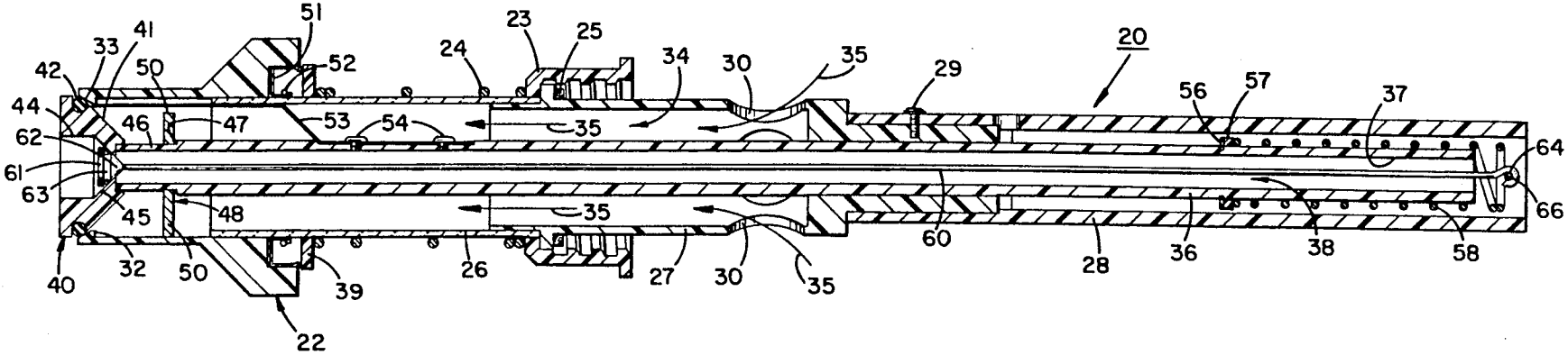
FIG. 2 is a cross-sectional side elevational view of the liquid delivery and filling system of the present invention taken along line 2—2 of FIG. 1.
Figure 3:
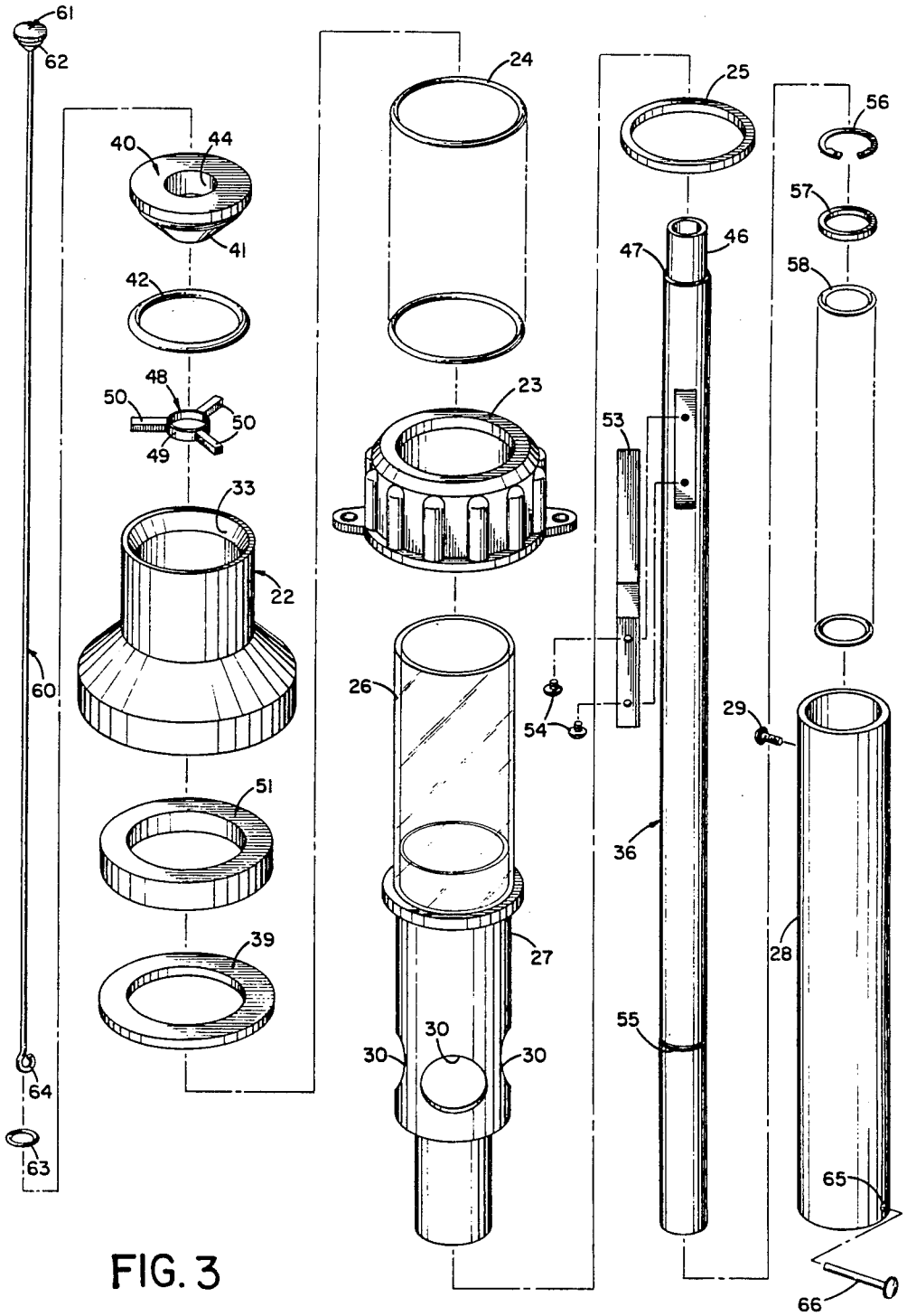
FIG. 3 is an exploded perspective view of the FLUID delivery/filling system of the present invention.

By referring to FIGS. 2 and 3, along with FIG. 1, in conjunction with the following detailed disclosure, the overall construction of liquid delivery/filling system 20 can best be understood. In the preferred construction, elongated outer tube 21 comprises three component parts. These components preferably comprise a clear, transparent section 26, a central section 27, to which transparent section 26 is fixedly mounted, and a distal section 28 which is removably mounted to central section 27 by screw means 29. In this way, distal section 28 can comprise alternate lengths, in order to cooperate with storage containers of any configuration.

In this preferred embodiment, central section 27 of elongated outer tube 21 incorporates a plurality of portals 30 formed therein. As is more fully detailed below, tube 21 defines flow path 34 along which the liquid to be transferred from the first container to the second container travels in the general direction shown by arrows 35.

In addition to outer elongated tube 21, liquid delivery/filling system 20 of the present invention also incorporates an inner elongated tube 36. Preferably, elongated tube 36 comprises an overall length which is less than the overall length of outer tube 21. Furthermore, tube 36 is preferably concentrically mounted within elongated tube 21 as well as being slidably engaged therewith.

Inner elongated, slidably engaged tube 36 incorporates a centrally disposed, elongated bore 37 extending the entire length thereof and defining a second flow path 38 for liquid delivery/filling system 20.

At the proximal end of inner elongated tube 36, a liquid flow controlling valve 40 is securely affixed. In the preferred embodiment, valve 40 comprises a generally annular shape having a conically shaped base. As a result, valve 40 comprises an outer conical shaped surface 41, the apex end of which is securely affixed to the proximal end of tube 36. At the opposed end of conical shaped surface 41, a sealing O-ring 42 is mounted. In addition, valve 40 comprises a portal 44 and an inner conical shaped surface 45.

As clearly shown in FIG. 2, when slidable collar 22 is in its forward-biased, flow preventing position, the sloping, ramped surface 33 of collar 22 is maintained in secure, engaged sealing contact with O-ring 42. Furthermore, collar 22 is normally held in this position by spring means 24, assuring that liquid flow through passageway 34 is prevented.

In order to prevent unwanted leakage of the liquid being transferred between the storage container and the active reservoir, slidable collar 22 incorporates a sealing ring assembly 51 securely affixed to collar 22 at the distal end thereof. In addition, sealing ring assembly 51 incorporates a coil spring 52 mounted therein which maintains a portion of sealing ring assembly 51 in biased frictional engagement with transparent section 26 of elongated tube 21. In this way, when collar 22 is in its forwardly biased sealed configuration, leakage of the liquid contained in passageway 34 is prevented.

In addition, in order to assure continuous, trouble-free axial slidability of collar 22 along transparent section 26, a washer 39 is mounted between collar 22 and spring means 24. In this way, washer 39 provides a bearing surface upon which compression spring 24 acts, as well as a solid surface for acting upon spring 24 as collar 22 is axially moved distally against the forces of spring 24.

As clearly shown in FIG. 2 and 3, the proximal end of inner elongated tube 36 incorporates a reduced diameter section 46, which terminates with layer diameter ledge 47 of elongated tube 36. In addition, movement control means 48 is mounted about reduced diameter section 46 and is constructed for slidable engagement therealong. In this way, movement control means 48 is free to slide along reduced diameter section 46 between flow controlling valve 40 and ledge 47.

In the preferred embodiment, movement control means 48 comprises a central, substantially circular ring 49 and three, substantially equal length arms 50 extending radially outwardly from the outer surface of ring 49. Preferably the length of each arm 50 is sufficient to extend arm 50 substantially to the inner diameter surface of slidable collar 22. In this way, flange 32 of collar 22 overlaps the terminating ends of arms 50 and is able to be moved into contacting engagement with the terminating ends of arm 50.

Inner elongated tube 36 also comprises, in the preferred embodiment, an elongated substantially flat metal plate member 53 securely mounted to the outer peripheral surface of elongated tube 36 by screw means 54. As is more fully detailed below, elongated, plate member 53 serves as a flow deflector for the liquid being transferred form the first storage container to the active reservoir.

Furthermore, towards the distal end of tube 36, a locking ring 56 is securely mounted in recess 55, with a washer 57 mounted adjacent thereto. Finally, coil spring 58 is mounted about the distal end of elongated tube 36, with one end of said coil spring 58 being engaged with washer 57, held in that position by locking ring 56.

The final major component incorporated in liquid filling/delivery system 20 of the present invention is elongated rod 60 which is mounted substantially along the central axis of liquid delivery/filling system 20. In the preferred construction, the overall length of rod 60 is greater than the overall length of inner elongated tube 36, while being less than the overall length of outer elongated tube 21. In addition, at the proximal end of rod 60, an air flow controlling valve 61 is securely affixed. Valve 61 incorporates a flow controlling, substantially conical shaped surface 62, the apex of which is securely affixed to the proximal end of rod 60. At the opposed end of conical surface 62, a sealing O-ring 63 is mounted.

As discussed above, flow controlling valve 40 comprises a substantially annular shape with a substantially centrally disposed portal 44 terminating with a ramped, substantially conical shaped surface 45. As shown in FIG. 2, flow controlling valve 61 is constructed for mating, flow controlling engagement with conical surface 45 of liquid flow controlling valve 40, with O-ring 63 of air valve 61 securely engaging with conical surface 45 when valve 61 is in its closed position. In this way, any flow of air through passageway 38 is prevented.

At its distal end, elongated rod 60 is preferably formed in a substantially hook shape to define an eyelet passageway 64. In addition, distal portion 28 of elongated outer tube 21 incorporates diametrically aligned through holes 65 through which pin 66 is securely mounted. As shown in FIG. 2, pin 66 passes through eyelet 64 of shaft 60, thereby securing shaft 60 in a substantially fixed, immovable position. Furthermore, coil spring 58, which abuts ring 57 at one end thereof is maintained in position with pin 66 holding the opposed end thereof under compression.

As detailed above, spring 58 is maintained under compression between pin 66 and ring 57. Since ring 57 securely abuts centrally mounted ring 56, the force of spring 58 causes elongated tube 36 to be pushed away from pin 66. However, since the axial movement of tube 36 is restricted by air flow controlling valve 61 mounted at the distal end of shaft 60, the combination of these elements causes passageway 38 of elongated tube 36 to be normally maintained in the closed, sealed configuration with flow controlling valve 61 and mating surfaces 44 of flow controlling valve 40 being held in secure sealed abutting engagement by compression spring 58.

As is apparent from the foregoing detailed description, liquid delivery/filling system 20 of the present invention is normally maintained in its completely sealed configuration, with both air flow controlling valve 61 and liquid flow controlling valve 40 being held in their closed position, preventing any flow through the two independent flow channels associated therewith. However, as detailed below, when liquid delivery/filling system 20 of the present invention is activated, flow controlling valves 40 and 61 sequentially open, in a controlled manner, assuring that any unwanted liquid spillage or vapor pressure build up is not released in a manner that could lead to a dangerous situation.

Figure 4:
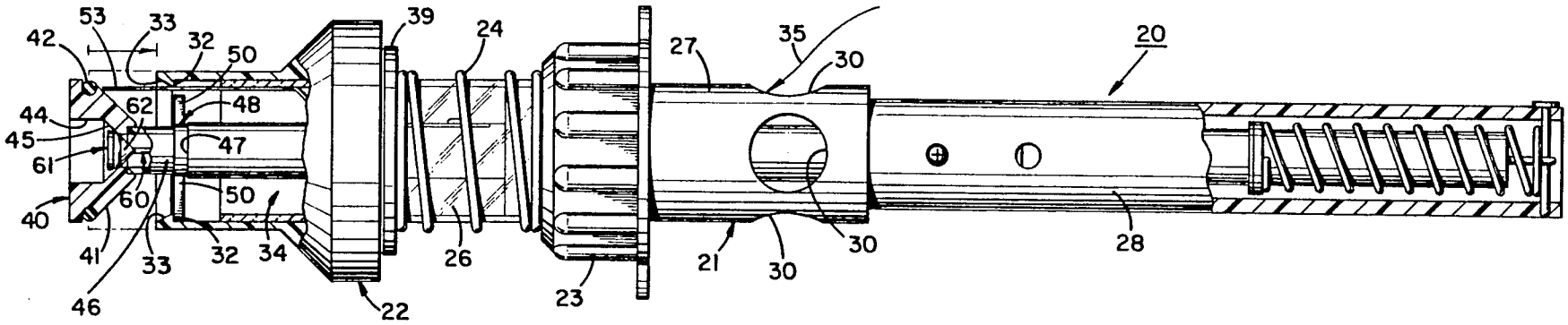
FIG. 4 is a side elevational view, partially in cross-section and partially broken away, of the fluid delivery and filling system of the present invention shown in its partially open position.
Figure 5:
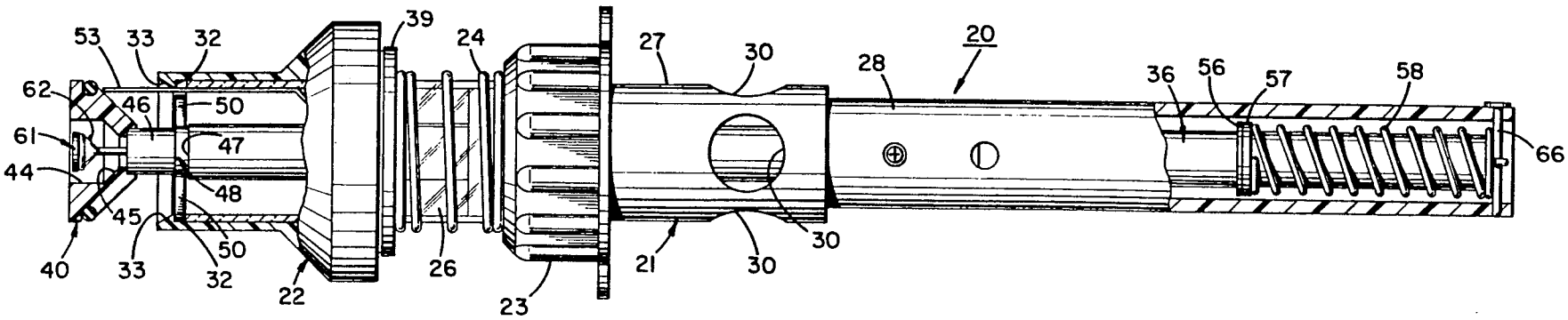
FIG. 5 is a side elevational view, partially in cross-section and partially broken away, of the fluid delivery/filling system of the present invention shown in its fully open position.

By referring to FIGS. 4 and 5, along with the following detailed disclosure, the sequential opening of flow paths 34 and 38 can best be understood. In addition, as is more fully detailed below, it is apparent that in normal use, cap 23 would be mounted to a liquid storage container with its associated O-ring 25 sealingly mounted with the container to prevent unwanted leakage. However, for purposes of clarity in the following explanation, liquid delivery/filling system 20 of the present invention is shown in FIGS. 4 and 5 without any associated storage container.

Before activating the liquid delivery/filling system 20 of the present invention by slidably moving collar 22, filling system 20 would be inserted into the active container or reservoir into which the liquid is to be transferred. This would be achieved by positioning funnel shaped collar 22 in the receiving aperture of the container or reservoir into which the liquid is to be transferred. For this reason, collar 22 is constructed with the overall funnel shape, with the outer diameter of the proximal end thereof being designed for easily fitting into the liquid receiving aperture formed in the normally used reservoirs.

In initially activating system 20 of the present invention, the user would slide collar 22 axially toward the distal end thereof, causing the compressive force of spring 24 to be increased.

As collar 22 is axially moved toward the distal end of system 20, ramped sealing surface 33 of collar 22 is removed from sealing engagement with O-ring 42 of flow controlling valve 40, thereby opening flow path 34 of outer tube 21. Once open, the liquid contained in the storage container is free to flow into portals 30 of central section 27 of elongated tube 21 through flow path 34 and out of system 20, passing between conical surface 41 of flow controlling valve 40 and ramp surface 33 of collar 22.

In addition, as collar 22 is axially moved distally, flange 32 of collar 22 captures arms 50 of movement control means 48. Regardless of the particular position movement control means 48 may be in movement control means 48 is captured by flange 32 and is moved axially along surface 46 until abutting ledge 47. As shown in FIG. 4, throughout this movement, inner elongated tube 36 remains in secure spring-biased engagement with air flow controlling valve 61, preventing any flow through path 38 associated therewith.

As a result, any high pressure, volatile vapors that may have built up in the storage container being dispensed is safely released directly into the container being filled, along with the liquid also stored in the container. Furthermore, during this initial actuation sequence, only the liquid flow path is open, thereby allowing only the liquid from the container to be dispensed with the high pressure volatile vapors that may have built up in the container merely causing added pressure on the liquid being dispensed, pushing the liquid more rapidly out of the container and into the reservoir to be filled. In this way, any dangerous result that might otherwise have occurred from the release of this volatile high pressure vapor is eliminated, by rendering the higher pressure harmless and, in fact, using the increased pressure to an advantage and more rapidly dispensing the liquid into the desired container.

Once the liquid flow channel or passageway 34 has been open, as detailed above, the continued sliding advance of collar 22 along proximal section 26 of elongated tube 21, with collar 22 advancing towards cap 23 in continued opposition to the compression force exerted by spring 24, the liquid delivery/filling system 20 of the present invention automatically causes the second passageway 38 to be opened.

As detailed above, when liquid carrying channel or passageway 34 is fully opened, movement control means 48 is captured between flange 32 of collar 22 and ledge 47 of inner elongated tube 36. As collar 22 is moved further towards the distal end of the delivery/filling system 20, the additional movement of collar 22 causes inner, elongated tube 36 to be axially moved in its entirety toward the distal end of system 20, until the distal end of elongated tube 36 comes into direct contact with pin 66, and arms 50 of movement control means 48 is sandwiched between flange 32 of collar 22 and the proximal edge of transparent section 26 of tube 21. As clearly shown in FIG. 5, the axial movement of elongated tube 36 into abutting contact with pin 66 causes spring 58 to be further compressed between pin 66 and ring 57.

Furthermore, the axial sliding movement of elongated tube 36 also causes the conical shaped surface 45 of liquid flow controlling valve 40 to become disengaged from sealing contact with conical surface 62 of air flow controlling valve 61. As a result, air flow passageway 38 of elongated tube 36 is open, allowing the air contained in the reservoir being filled to be automatically channeled through passageway 38, while the liquid entering the reservoir freely flows through passageway 34 of outer elongated tube 21.

As is readily apparent from the preceding detailed disclosure, the liquid delivery/filling system 20 of the present invention automatically achieves sequential, controlled actuation of a liquid flow path and a separate, independent air flow path in a precise trouble-free controlled manner.

By providing the sequential, controlled actuation of a liquid flow channel or passageway and a separate, independent air flow channel or passageway, a liquid delivery/filling system is attained which eliminates the prior art problems and difficulties encountered in transferring volatile liquids from one container to an active reservoir. By employing the delivery/filling system of the present invention, all flow of the volatile liquid is prevented until specifically initiated by the user, with any pressure built up in the storage container being used to the system's advantage free of any harm or unwanted spillage or contact with hot surfaces.

Furthermore, once the volatile liquid flow has been initiated, the air flow passageway is automatically opened to allow the liquid entering the active reservoir to easily displace the air contained in the reservoir, while the air is safely channeled into the storage container in a completely separate flow channel which delivers the air to the area of the container which is furthestmost from the exit portal for the volatile liquid. This construction is most clearly shown in FIG. 6, wherein the liquid delivery/filling system 20 of the present invention is shown in one typical system in actual use.

Figure 6:
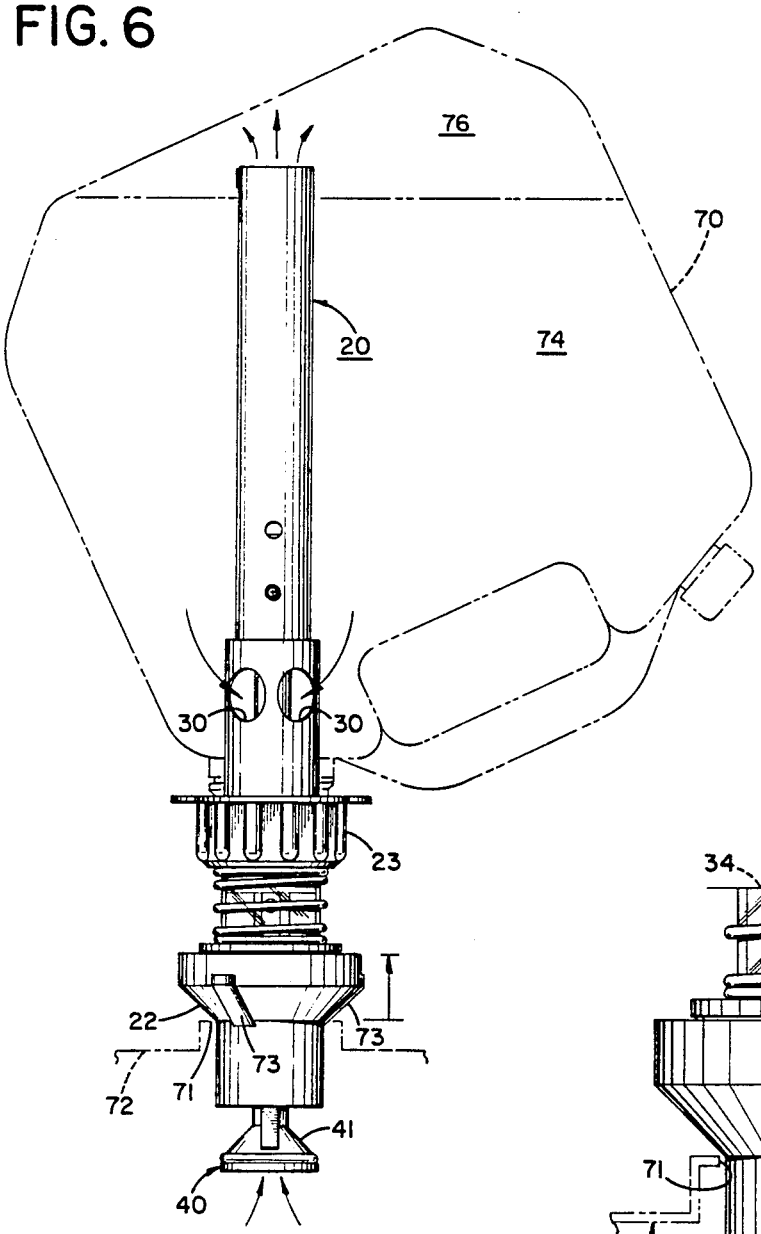
FIG. 6 is a diagrammatic view, partially in cross-section and partially broken away showing the liquid delivery/filling system of the present invention in use transferring fluid from one reservoir into another.

As depicted in FIG. 6, liquid delivery/filling system 20 of the present invention is securely affixed to a conventional liquid storage tank 70, with cap 23 threadedly engaged to container 70 in sealing contact therewith, preventing any unwanted leakage. Furthermore, funnel shaped collar 22 is inserted into the open mouth 71 of reservoir 72 into which the liquid 74 in storage container 70 is to be transferred. As clearly shown in FIG. 6, liquid 74 is easily emptied from container 70, since portals 30 are positioned near the mouth of container 70. In this way, all the liquid 74 stored in container 70 can be removed therefrom and transferred to reservoir 72.

In the embodiment shown in FIG. 6, funnel-shaped collar 22 incorporates a plurality of optional ribs 73, extending from the outer conical funnel-shaped surface thereof. By employing ribs 73, the funnel-shaped surface of collar 72 is prevented from forming a complete seal with mouth 71 of reservoir 72. Instead, air gaps are established between mouth 71 and the funnel-shaped surface of collar 22 adjacent the plurality of ribs 73. As a result, by using this embodiment, any vapor pressure build-up within reservoir 72 is safely dissipated through the gaps formed between mouth 71 and the funnel-shaped surface of collar 22, without causing any adverse effects.

In addition, the distal end of system 20 is clearly shown to extend to the furthestmost location of container 70. In this way, the distal end of system 20 extends into the region above the liquid level, in order to allow the delivery of the air displaced from reservoir 72 into an air zone 76 above liquid level 74 of container 70. In this way, the displaced air is not forced to bubble through the liquid being delivered which typically causes irregular flow patterns for the liquid as well as potential spilling or uncontrolled liquid flow. By employing the present invention, these adverse flow patterns are completely eliminated and a free flowing safe flow path is achieved for liquid 74 as it is transferred from container 70 into reservoir 72.

The free flow of the liquid 74 from container 70 continues in a manner described above, with the displaced air passing around air control valve 61 through passageway 38 of inner elongated tube 36 until reservoir 72 is almost completely full. From the time the liquid begins flowing until container 72 is almost completely full, liquid 74 flows through passageway 34 of elongated tube 21 with the liquid flowing out of collar 22 between the inner surface thereof and the outer conical surface 41 of liquid flow control valve 40.

This free, rapid, controlled flow of liquid 74 with the controlled independent transferal of the displaced air through passageway 38 of inner elongated tube 36 continues until the liquid level in container 72 reaches the proximal edge of liquid flow control valve 40. At this time, air can no longer freely flow through elongated tube 36, since the liquid level in reservoir 72 has effectively sealed the opening to passageway 38. However, in order to allow all of the liquid in container 70 to be added to reservoir 72, the liquid delivery/filling system 20 of the present invention incorporates deflector 53.

Figure 7:
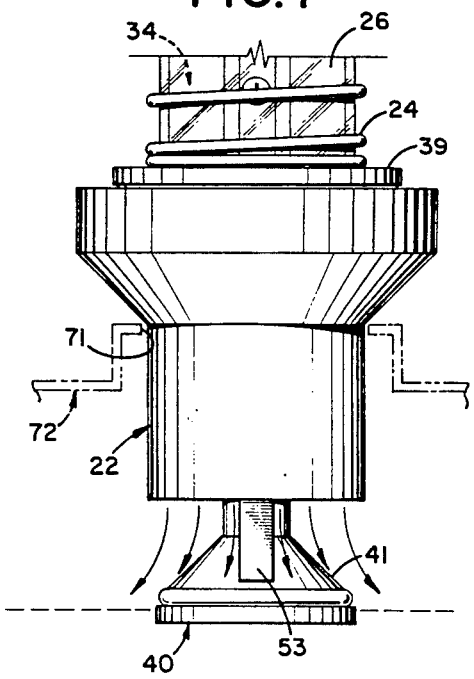
FIG. 7 is a side elevational view of the liquid delivery/filling system of the present invention shown in operation as the tank being filled nears completion.

As shown in FIG. 7, the liquid freely flows through collar 22, between the inner surface thereof and the conical outer surface 41 of liquid flow control valve 40 even when air can no longer flow through passageway 38. Without deflector 53, a complete conical shaped flow path would be established and the displaced air could not escape. However, with deflector 53, the liquid is prevented from completing a full conical shape. Instead, an open path is formed by deflector 53. As a result, air which is incapable of now passing through passageway 38 of tube 36 can pass in the reverse direction, through passageway 34 of tube 21, due to the opening provided in the conical flow path by deflector 53.

In the preferred embodiment, proximal section 26 of elongated outer tube 21 comprises transparent material. In this way, the user of system 20 can easily see the air exiting through passageway 34 by the bubbling effect visual through proximal section 26. As a result, the operator knows that reservoir 72 is substantially filled and flow will soon cease completely or, if desired, can be manually terminated by removing system 20 from reservoir 72.

It has also been found that by eliminating deflector 53, the unbroken, continuous, conical shaped flow pattern achieved by the liquid delivery/filling system 20 of the present invention operates efficiently to fill reservoir 72 up to the leading edge of valve 40. However, when the air can no longer flow through passageway 38 of inner elongated tube 36, flow automatically ceases. As a result, the preferred embodiment of system 20 incorporates deflector 53. However, if desired, a delivery system can be constructed without deflector 53.

With deflector 53 in place, free flow of liquid 74 from container 70 continues until either all of the liquid has been removed from container 70 or, until, the liquid 74 in reservoir 72 has reached the proximal edge of collar 22. If the liquid 74 fills up to the proximal edge of collar 22, further flow of the liquid will be prevented. At this time, liquid delivery/filling system 20 would be removed from reservoir 72 and the vehicle being filled can be returned to operation.

Upon removal of liquid delivery/filling system 20 from its fully open, free flowing position, as depicted in FIG. 5, the system is automatically returned to the completely sealed configuration, shown in FIG. 2. As is apparent from the preceding detailed disclosure, coil spring 58 forces inner elongated tube 36 towards the proximal end of system 20, bringing air flow controlling valve 61 into sealing engagement with conical surface 45 of liquid flow controlling valve 40.

In addition, coil spring 24 forces collar 22 forward, toward the proximal end of system 20, bringing ramped surface 33 of collar 22 into abutting, sealing engagement with O-ring 42 and conical surface 41 of liquid flow control valve 40. In this way, system 20 is automatically returned to its sealed configuration, with both independent flow channels 34 and 38 completely closed, with system 20 remaining in this configuration until manually activated for future use.

In FIGS. 8, 9, 11 and 12, the preferred embodiment of integrated, interlocking, mating/liquid transfer assembly 100 of the present invention is shown. In this embodiment, liquid transfer assembly 100 incorporates a housing 101 connecting one end thereof to a supply tube 102. In order to control the flow of the toxic chemical liquid being supplied, a valve assembly 103 is preferably mounted between supply tube 102 and housing 101.

Figure 9:
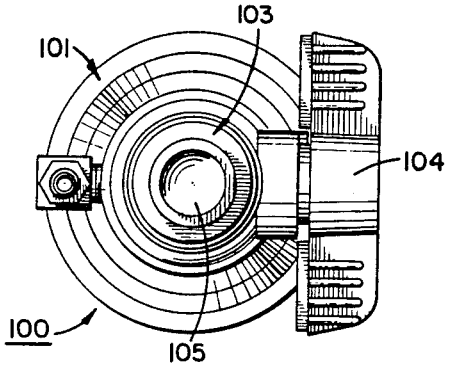
FIG. 9 is a top plan view of the liquid transfer assembly of FIG. 8.

In this preferred embodiment, valve assembly 103 comprises a conventional pivotal ball 105 which incorporates a passageway therethrough. Ball 105 is constructed for rotational movement about its central axis, within valve assembly 103, with the movement of ball 105 being controlled by handle 104. Typically, handle 104 rotates through an arc of about 90°, controllably pivoting ball 105 between its two alternate positions, a closed position, as shown in FIG. 9, wherein flow through tube 102 to housing 101 is prevented and an open position, wherein the passageway is aligned with tube 102 and housing 101 to allow the liquid to flow therethrough.

Housing 101 of interlocking, mating/liquid transfer assembly 100 incorporates a central body portion 108 and a peripherally surrounding, depending wall portion 109 extending from body portion 108 in a direction opposite from valve assembly 103. Body portion 108 is connected to one end of valve assembly 103 and, as is more fully detailed below, incorporates, in the preferred embodiment, a separate, flow-control means to prevent the passage of the toxic chemical liquid through liquid transfer assembly 100 when not desired. In addition, fitting 106 is threadedly mounted in body portion 108, providing a venting passageway between the interior and exterior of body portion 108.

Figure 8:
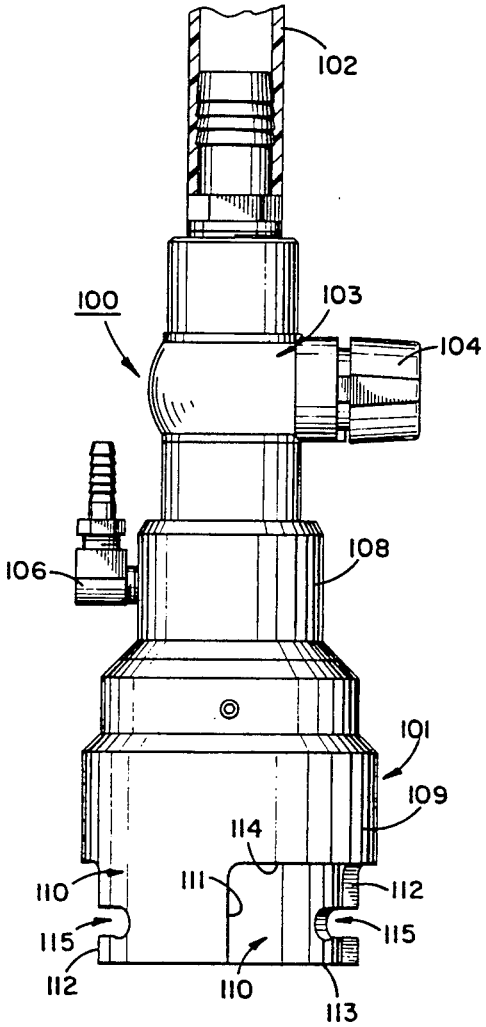
FIG. 8 is a side elevational view showing the liquid transfer assembly of the present invention.

As shown in FIGS. 8 and 11, wall portion 109 of housing 101 comprises a substantially hollow cylindrical shape and incorporates two flange portions 110, 110 each extended from lower edge 114 of wall portion 109 and comprising vertical side edges 111 and 112, and bottom edge 113. In addition, both vertical side edges 112 incorporate a slot 115 which extends substantially perpendicularly to side edge 112 inwardly therefrom, substantially parallel to lower edge 113.

Figure 10:
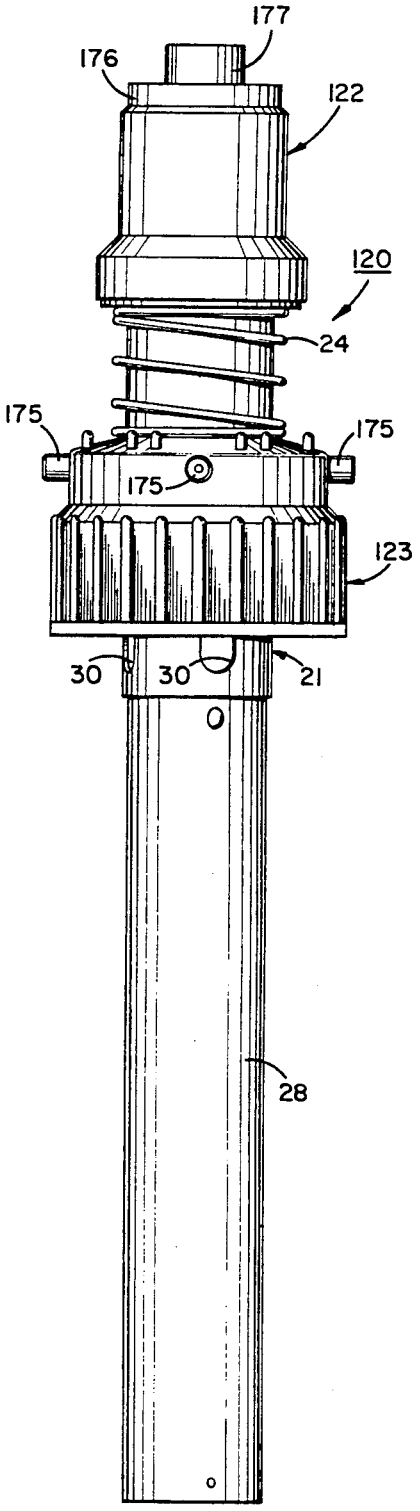
FIG. 10 is a side elevation view showing a slightly modified embodiment of the liquid delivery/filling system of this invention.

In FIG. 10, the liquid delivery/filling system of this invention is depicted in a slightly altered embodiment. In this embodiment, liquid delivery/filling system 120 is constructed substantially identically to the construction detailed above and shown in FIGS. 1-7. In fact, if desired, the embodiments detailed above can be employed directly with integrated mating liquid transfer assembly 100 of this invention. However, in order to provide the desired interlocking mating interengagement of liquid transfer assembly 100 with the liquid delivery/filling system of this invention, the embodiment shown in FIG. 10 is preferred.

As shown in FIG. 10, liquid delivery/filling system 120 incorporates a plurality of radially extending pins 175 which extend from sealing cap 123. In addition, slidable collar 122 is preferably constructed in the manner depicted in FIG. 10, incorporating an extending flange 176 which peripherally surrounds and encloses liquid flow controlling valve 40. In addition, liquid flow controlling valve 40 incorporates an axially extending, upstanding hollow cylindrically-shaped wall portion 177. Other than these minor modifications, liquid delivery/filling system 120 is otherwise constructed substantially identically to liquid delivery/filling system 20 detailed above and shown in FIGS. 1-7.

In FIG. 11, liquid delivery/filling system 120 is shown securely affixed to a typical toxic chemical liquid storage container 200 which, in this embodiment, incorporates side handles 201 in order to more easily lift and maneuver storage container 200. As detailed above, in the preferred embodiment, liquid delivery/filling system 120 is preferably permanently affixed to container 200 in order to prevent its removal by the user. In this way, assurance is provided that container 200 is reusably employable for transferring the concentrated chemical liquid contained therein to the active reservoir for dilution, and not disposed of with chemical residue contained therein after a single use.

As shown in FIGS. 11 and 12, integrated interlocking mating liquid transfer assembly 100 is depicted securely mounted to liquid delivery/filling system 120 to enable container 200 to be refilled for subsequent use. Mating liquid transfer assembly 100 is quickly and easily securely mounted in locked interengagement with liquid delivery/filling system 120 by mounting housing 101 about slidable collar 122 and telescopically advancing transfer assembly 100 onto liquid delivery/filling system 120, causing collar 122 to move axially downward into its open position.

Once liquid delivery/filling system 120 is in its open position, system 120 is locked in this open position by rotating assembly 100 about its central axis into locked engagement with liquid delivery/filling system 120. When rotated about its central axis, slots 115 formed in flange 110 of housing 101 advance into locked interengagement with radially extending pins 175 of sealing cap 123. In this way, liquid transfer assembly 100 is maintained in locked interengagement with liquid delivery/filling system 120 until transfer assembly 100 is purposefully rotated about its central axis to disengage assembly 10 from delivery/filling system 120.

By referring to FIG. 12, along with the following detailed disclosure, the safe, secure, controlled, spill-free liquid delivery flow paths established by the locked interengagement of transfer assembly 100 and liquid delivery/filling system 120 can best be understood. As clearly apparent from FIG. 12, the overall construction and shape of stepped, hollow, cylindrical depending wall portion 109 of housing 10 is dictated by the outer surface configuration of slidable collar 122 of liquid delivery/filling system 120. Consequently, the shapes of these members may be altered without departing from the scope of this invention. However, regardless of the changes made, cooperation therebetween must be maintained.

As shown in FIG. 12, wall portion 109 is constructed with inside walls 180 and 181 having two separate and distinct diameters, with the juncture therebetween being defined by collar engaging ledge 182. In this construction, the diameter of wall 180 is defined by the overall outer diameter of slidable collar 122, while the overall diameter of second wall 181 is constructed to be greater than the overall diameter of the rear enlarged flange portion of collar 122. In addition, ledge 182 is positioned for contacting slidable collar 122 precisely at the juncture between the dual diameter zones, so as to engage and force slidable collar 122 to move along its central axis, compressing spring 24.

By incorporating collar engaging ledge 182 as a portion of wall 109 of housing 101, assurance is provided that the telescopic mounting engagement of housing 101 onto liquid delivery/filling system 120 automatically causes slidable collar 122 to be moved from its closed position to its open position, thereby establishing the opening of the desired flow paths. In addition, as detailed above, housing 101 is constructed to assure that liquid delivery/filling system 120 is locked in the desired open configuration by the engagement of elongated slots 115 with radially extending pins 175. Consequently, whenever housing 101 of liquid transfer assembly 100 is telescopically mounted to liquid delivery/filling system 120 in a manner which enables radially extending pins 175 to be positioned in locked engagement within slots 115 of wall portion 109, assurance is provided that liquid delivery/filling system 120 is secured and maintained in its open position, with both of its liquid air flow paths fully usable.

In order to assure trouble-free transferal of the concentrated toxic liquid from the primary supply to container or reservoir 200, central portion 108 of housing 101 of liquid transfer assembly 100 incorporates valve 184. Normally, valve 184 is maintained in biased interengagement with conical shaped wall 186 by spring means 185. In this way, whenever liquid transfer assembly 100 is disconnected from a delivery/filling system 120, valve 184 is maintained in secure, biased, flow-stopping engagement with wall 186. As a result, regardless of the position of handle 104 and the ball valve to which it is connected, flow of the toxic liquid through liquid transfer assembly 100 of this invention is automatically prevented, whenever assembly 100 is disconnected from engagement with the delivery/filling system.

In addition, in the preferred embodiment, sloping wall 186 terminates at one end thereof with an inside, upstanding, substantially circular-shaped portal defining wall 187 which is positioned directly adjacent valve 184, forming the portal entry thereto. As clearly shown in FIG. 12, portal defining wall 187 comprises a diameter slightly greater than the diameter of upstanding flange 177 of slidable collar 122. In this way, the precisely desired telescopically aligned interengaged relationship of liquid delivery/filling system 120 and liquid transfer assembly 100 is assured and mating locked interengagement in the precisely desired position is effortlessly attained.

As shown in FIG. 12, when liquid delivery/filling system 120 is matingly lockingly interengaged with liquid transfer assembly 100, valve 184 of liquid transfer assembly 100 is forced out of engagement with sloping wall 186, thereby assuring that flow through valve 184 is provided. By properly telescopically matingly engaging liquid delivery/filling assembly 120 with liquid transfer assembly 100, valve 61 mounted at the terminating end of rod 60 of liquid delivery/filling assembly 120 is brought into abutting contacting engagement with valve 184 of liquid transfer assembly 100, causing valve 184 to be forced out of engagement with sloping wall 186, thereby opening the desired flow path.

In addition, the mating telescopic engagement of upstanding flange 177 in wall 187 assures that valve 61 is properly positioned for contacting valve 184 and forcing valve 184 into its open position. In addition, once liquid delivery/filling assembly 120 is locked in mating engagement with liquid transfer assembly 100, valve 184 is maintained in the open configuration until liquid transfer assembly 100 is disengaged and removed therefrom.

Once liquid transfer assembly 100 and liquid delivery/filling system 120 are positioned in locked interengagement with each other, as detailed above, and handle 104 of ball valve section 103 is rotated to open ball valve 103, the toxic liquid from the supply tank or other storage medium is able to flow through tubing 102 and valve assembly 103 into liquid transfer assembly 100. As detailed above, with valve 184 in the open position, the liquid is capable of flowing past valve 184 and valve 61 directly into passageway 38 of liquid delivery/filling system 120. As detailed above, passageway 38 extends through the entire length of liquid delivery/filling assembly 120, thereby enabling the liquid flow to pass completely through passageway 38 directly into storage container 200.

As container 200 begins to be filled with the desired toxic chemical liquid, the air originally within container 200 is displaced and is forced to exit container 200. As shown in FIG. 12, the exiting air is easily removed from container 200 by passing through portals 30 of system 120 which connect directly to passageway 34. The air flow continues through passageway 34, enabling the air from container 200 to exit between valve 40 and slidable collar 122.

Once the air from container 200 has exited completely through passageway 34 and liquid delivery/filling system 120, air enters the inside chamber defined by wall 180 of central portion 108 of liquid transfer assembly 100. However, as clearly shown in FIG. 12, the exiting air flow is precisely in the zone where fitting 106 has been threadedly engaged in the wall of central section 108. As a result, the air passing through passageway 34 of liquid delivery/filling assembly 120 merely exits through fitting 106 and its associated tubing to the desired vent location.

By employing this construction, any toxic chemical liquid is capable of being safely and efficiently delivered directly into storage container 200 with any chance of spilling or leaking of toxic liquid being completely eliminated. Furthermore, complete control of the flow of the liquid, as well as removal of the air from container 200, is efficiently provided.

As is apparent from this detailed disclosure, the passageways of liquid delivery/filling assembly 120 are employed in reverse to the use of these flow channels provided during the transfer of liquid from storage container 200 to the desired active reservoir. However, regardless of the use of the liquid flow path as an air flow path and the use of the air flow path as a liquid flow path, the safe, efficient, transfer of the desired toxic liquid into container 200 is efficiently attained.

Once container 200 has been completely filled, as would be evident by external observation of container 200, as well as by suitable markings preferably positioned thereon, the flow of the liquid would be terminated by rotating handle 104 to prevent any further flow of the liquid into housing 101 of liquid transfer assembly 100. Once the flow has ceased, liquid transfer assembly 100 is quickly and easily removed from liquid delivery/filling system 120 by rotating liquid transfer assembly 100 out of locked interengagement with pins 175. Once disengaged, liquid transfer assembly 100 is easily lifted and removed therefrom. Once removed, slidable collar 122 is automatically forced by spring means 24 into its closed position, thereby enabling refilled container 200 to be taken and re-used by delivering the desired toxic chemical liquid to the usable tank for dilution and application to the desired site.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. An integrated, cooperating liquid flow controlling system for delivering a desired liquid from a first storage reservoir to a second active reservoir and also for providing trouble-free refilling of the first storage reservoir whenever required, with all liquid transfer being achieved in a controlled manner with over-filling, spillage, and pressure build up virtually eliminated, said flow controlling system comprising A. a liquid delivery/filling assembly comprising
   a. a first flow channel;
   b. a second, separate and independent flow channel positioned for cooperative association with said first flow channel; and
   c. actuation control means cooperatively associated with said first flow channel and said second flow channel for sequentially opening the flow channels whenever said control means is activated; and B. a liquid transfer assembly constructed for mating, cooperating mounted engagement with the liquid delivery/filling assembly and comprising
   a. a valve assembly
      1. connectable at one end thereof to a source of said liquid, and
      2. movable between a first flow stopping position and a second flow permitting position, and
   b. a housing constructed for cooperating, mating, telescopic overlying interengagement with the liquid delivery/filling system assembly and incorporating
      1. a central section having a liquid delivery flow channel, with one end thereof connected to the valve assembly, and
      2. a wall section extending from the end of said central section opposite the valve assembly and comprising
         i. means for engaging and activating the control means of the liquid delivery/filling assembly, thereby causing the first and second flow channels thereof to be opened, and
         ii. means for securely locking and engaging the housing with the liquid delivery/filling assembly and for maintaining said locked interengagement until removal thereof is desired.

2. The integrated, cooperating mating, liquid flow controlling system defined in claim 1, wherein the housing of the liquid transfer assembly is further defined as incorporating vent means to enable air to exit from the inside of said housing to the outside thereof.

3. The integrated, cooperating mating, liquid flow controlling system defined in claim 2, wherein the liquid delivery/filling system further comprises radially extending pins formed thereon and said locking means of the liquid transfer assembly is further defined as comprising at least one depending flange member extending from said wall section of the housing and incorporating pin receiving slots positioned for engaging the radially extending pins formed on the liquid delivery/filling system when the control means of the liquid delivery/filling system has been fully activated and both the first and second flow channels thereof are opened.

4. The integrated, cooperating mating, liquid flow controlling system defined in claim 3, wherein said housing is further defined as being constructed for telescopic interengagement with the liquid delivery/filling assembly for providing automatic, control actuation of the liquid delivery/filling assembly and the maintenance of the liquid delivery/filing assembly in the open position when said housing is lockingly engaged therewith.

5. The integrated, cooperating mating, liquid flow controlling system defined in claim 1, wherein the central section of said housing of the liquid transfer assembly is further defined as comprising a spring biased safety valve member formed therein and normally maintained in the closed position, thereby normally preventing flow through said housing, regardless of the position of the movable valve assembly.

6. The integrated, cooperating mating, liquid flow controlling system defined in claim 5, wherein said liquid delivery/filling system is further defined as comprising an upstanding, valve engaging wall portion extending from the proximal end thereof, positioned for mating, contacting engagement with said spring biased safety valve member of said liquid transfer assembly, for automatically moving said spring biased valve member out of its flow stopping position when the liquid delivery/filling assembly is telescopically securely mounted in locked interengagement with the liquid transfer assembly, whereby the safety, valve member is automatically moved from its flow stopping position into its flow permitting position only when the liquid transfer assembly has been properly securely mounted to the liquid delivery/filling assembly.

7. The integrated, cooperating mating liquid flow controlling system defined in claim 1, wherein the liquid being transferred is further defined as comprising a flammable, highly volatile liquid.

8. The integrated, cooperating mating liquid flow controlling system defined in claim 1, wherein said liquid is further defined as comprising a toxic or hazardous chemical liquid.

9. The integrated, cooperating mating liquid flow controlling system defined in claim 8, wherein said liquid comprises one selected from the group consisting of pesticides, fertilizers, and insecticides.

10. The integrated, cooperating mating liquid flow controlling system defined in claim 1, wherein both the first and second flow channels of the liquid delivery/filling assembly are further defined as being positioned concentrically to each other.

11. The integrated, cooperating mating, liquid flow controlling system defined in claim 10, wherein both the first and second flow channels are further defined as being normally maintained in a closed, sealed configuration, requiring the application of an actuation force to open said flow channels.

* * * * *